US006371808B2

(12) United States Patent
Sakaguchi

(10) Patent No.: US 6,371,808 B2
(45) Date of Patent: Apr. 16, 2002

(54) WIRE MODULE AND METHOD OF PRODUCING SAME

(75) Inventor: Masaharu Sakaguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/825,934

(22) Filed: Apr. 5, 2001

Related U.S. Application Data

(62) Division of application No. 09/513,167, filed on Feb. 25, 2000.

(30) Foreign Application Priority Data

Feb. 25, 1999 (JP) ..... 11-048072

(51) Int. Cl.[7] ..... H01R 13/58
(52) U.S. Cl. ..... 439/604; 29/855
(58) Field of Search ..... 439/207, 209, 439/210, 502, 604, 606, 736; 29/855, 856

(56) References Cited

U.S. PATENT DOCUMENTS 5,664,964 A * 9/1997 Crofoot et al. ..... 439/495
5,926,952 A 7/1999 Ito ..... 29/883

FOREIGN PATENT DOCUMENTS

JP 7-114970 5/1995 ..... H01R/43/24

* cited by examiner

*Primary Examiner*—Khiem Nguyen
(74) *Attorney, Agent, or Firm*—Sughrue Mion, PLLC

(57) ABSTRACT

In a wire module (1), a terminal (4, 5) is pressed to be clamped to each of opposite end portions of a wire (6) to thereby provide a terminal-assembled wire member (2), and molded connector members (10, 11) and a wire circuit member (12) are formed in such a manner that a plurality of terminal-assembled wire members are arranged in an insulative covering layer (3). In the case where the terminals (4) are of the female type, the molded connector member comprises a connector housing, in which the terminal-assembled wire members (2) are inserted, and a terminal holder attached to a terminal-inserting side of the connector housing. The connector housing is of the waterproof type, and includes a waterproof wall which is formed in a bulged manner on an outer peripheral surface of a housing body, receiving the terminals therein, and extends in a direction away from the terminal-inserting side. In the case where the terminals (5) are of the male type, the molded connector member includes a terminal-erecting holder fixing the terminal-assembled wire members and the wires.

4 Claims, 6 Drawing Sheets

WIRE MODULE AND METHOD OF PRODUCING SAME

This is a divisional of Application Ser. No. 09/513,167 filed Feb. 25, 2000, the disclosure of which is incorporated herein by reference.

BACKGROUND OF THE INVENTION

1. Field of the Invention

The present invention relates to a wire module, having a plurality of terminal-assembled wire members insert-molded therein, and the present invention also relates to a method of producing this wire module.

The present application is based on Japanese Patent Application No. Hei. 11-48072, which is incorporated herein by reference.

2. Description of the Related Art

When terminal-assembled wire members are insert-molded with a resin material, there is a possibility that the resin material (flash) intrudes into terminals through front ends thereof in the case where these terminals are of the female type. Therefore, there has been encountered a problem that the quality of the molded product is adversely affected.

Therefore, there has been proposed a method in which terminals are inserted into a connector housing to provide a connector, and this connector is insert-molded with a resin material.

However, in the case where the connector housing is not of the waterproof type, there has been encountered a disadvantage that the resin material leaks from a rear side of the connector during the insert-molding operation.

On the other hand, in the case where the terminals are of the male type, there is no chance that the resin material (flash) intrudes into these terminals through front and rear ends thereof.

However, when it is necessary to effect the insert-molding in such a manner that those portions of wires, disposed adjacent to the terminals, are bent into an L-shape, there has been encountered a disadvantage that the wires are displaced out of position during the insert-molding operation. In the worst case, there is a possibility that such displaced wires are sandwiched between molding dies.

SUMMARY OF THE INVENTION

With the above problems in view, it is an object of the present invention to provide a wire module in which the leakage of a resin material and the wire sandwiching engagement of molding dies are prevented when terminal-assembled wire members are insert-molded in the resin material. Another object is to provide a method of producing this wire module.

To achieve the above object, according to the first aspect of the present invention, there is provided a wire module which comprises a terminal-assembled wire member including a wire and at least two terminals to which opposite end portions of the wire are connected, a wire circuit member including an insulative covering layer by which the terminal-assembled wire member is partially covered, and at least two molded connector members formed respectively on opposite end portions of the terminal-assembled wire member.

According to the second aspect of the present invention, it is preferable that the insulative covering layer covers at least parts of the molded connector members.

According to the third aspect of the present invention, in the case where the terminals are of the female type, preferably, each of the molded connector members comprises a connector housing in which the end portion of the terminal-assembled wire member is inserted, and a terminal holder attached to a terminal-inserting side of the connector housing. According to the fourth aspect of the present invention, it is further preferable that the connector housing is of the waterproof type, and includes a waterproof wall which is formed in a bulged manner on an outer peripheral surface of the connector housing, receiving the terminals therein, and extends in a direction away from the terminal-inserting side.

According to the fifth aspect of the present invention, in the case where the terminals are of the male type, preferably, each of the molded connector members comprises a terminal-erecting holder which fixes the wire and one of terminals of the terminal-assembled wire member. According to the sixth aspect of the present invention, it is further preferable that the terminal-erecting holder includes a frame body of a U-shaped cross-section, a plurality of terminal press-fitting holes formed through a top wall of the frame body, and wire holding grooves formed in a free end of one of two support walls of the frame body.

According to the seventh aspect of the present invention, there is provided a method of producing a wire module which comprises the steps of connecting female terminals to opposite end portions of a wire to form a terminal-assembled wire member, inserting opposite end portions of the terminal-assembled wire member into connector housings molded of a heat-resistant resin material, insert-molding the connector housings with a resin material which is different from the heat-resistant resin material of which the connector housings are molded, and molding the terminal-assembled wire member with a resin material to form an insulative covering layer which covers the terminal-assembled wire member.

According to the eighth aspect of the present invention, it is preferable that the method further comprises a step of attaching terminal holders respectively to terminal-inserting sides of the connector housings.

According to the ninth aspect of the present invention, it is preferable that the molding step includes covering at least parts of the connector housings with the insulative covering layer.

According to the tenth aspect of the present invention, it is preferable that the connector housings are of the waterproof type, and each of which includes a waterproof wall which is formed in a bulged manner on an outer peripheral surface of a housing body, receiving the terminals therein, and extends in a direction away from the terminal-inserting side.

DETAILED DESCRIPTION OF THE PREFERRED EMBODIMENTS

A preferred embodiment of the present invention will now be described with reference to the drawings. In the following description, the term "hole" means a hole having opposite open ends, and the term "cavity" means a hole having one open end.

FIGS. 1 to 12 show one preferred embodiment of a wire module of the present invention.

Figure 1:
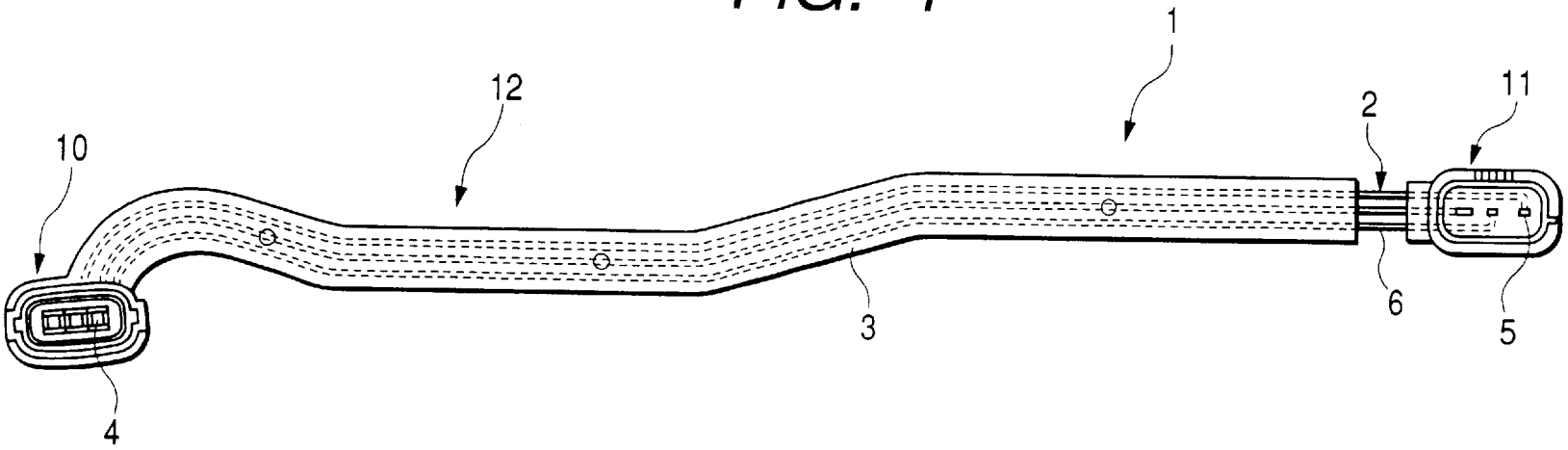
FIG. 1 is a plan view showing one preferred embodiment of a wire module of the present invention.
Figure 2:
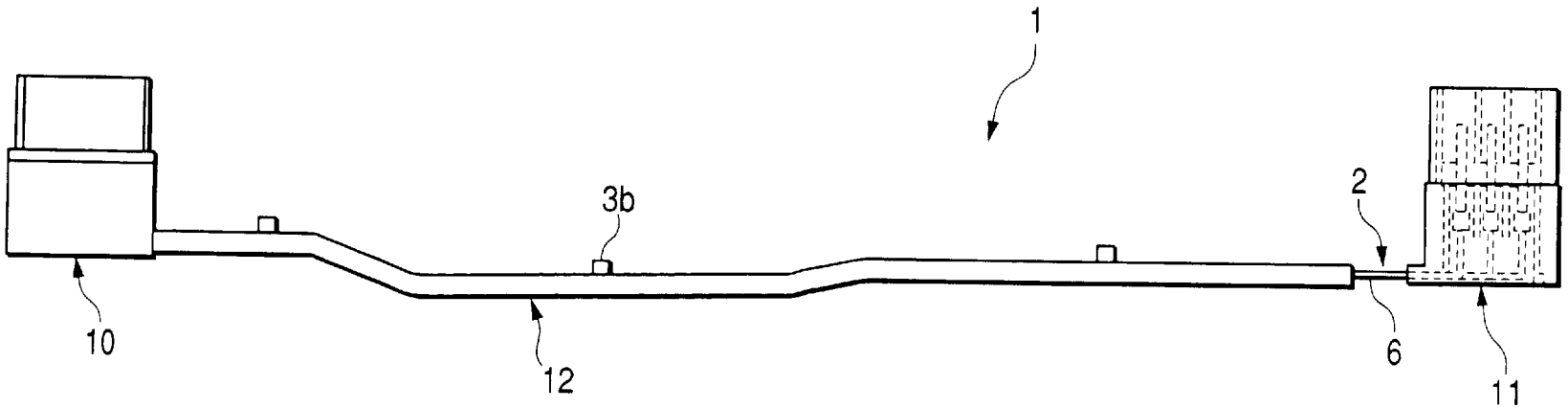
FIG. 2 is a side-elevational view of the wire module of FIG. 1.

As shown in FIGS. 1 and 2, this wire module 1 comprises terminal-assembled wire members 2, and an insulative covering layer 3 having the plurality of terminal-assembled wire members 2. Terminals 4 of the terminal-assembled wire members 2 are insert-molded with a resin material, thereby providing a molded connector member 10, and terminals 5 of the terminal-assembled wire members 2 are insert-molded with a resin material, thereby providing a molded connector member 11. Wires 6 of the terminal-assembled wire members 2 are insert-molded with a resin material, thereby providing a wire circuit member 12.

Figure 3:
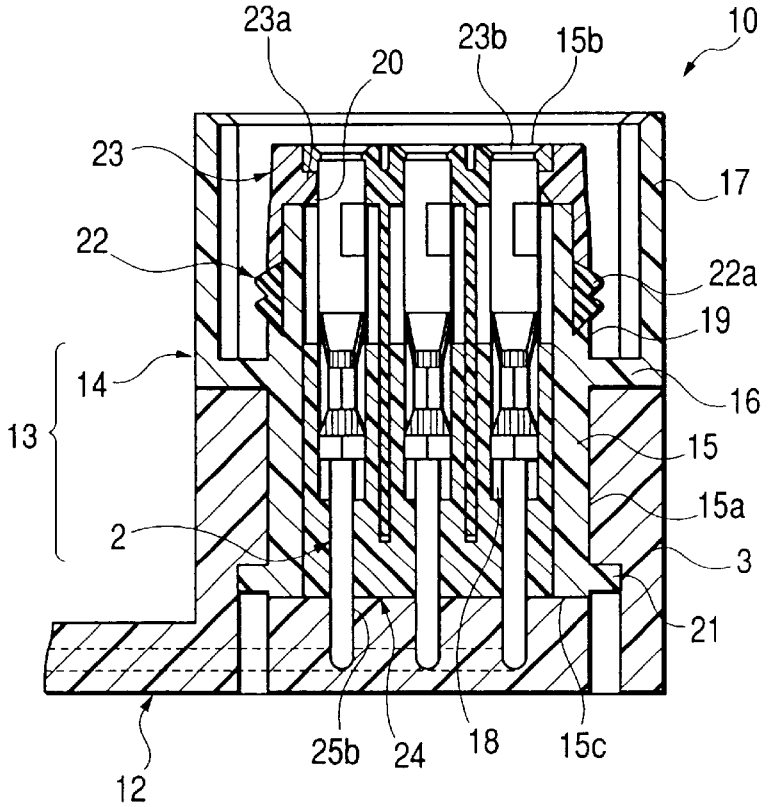
FIG. 3 is a vertical cross-sectional view of a molded connector member 10 in FIG. 1.
Figure 4:
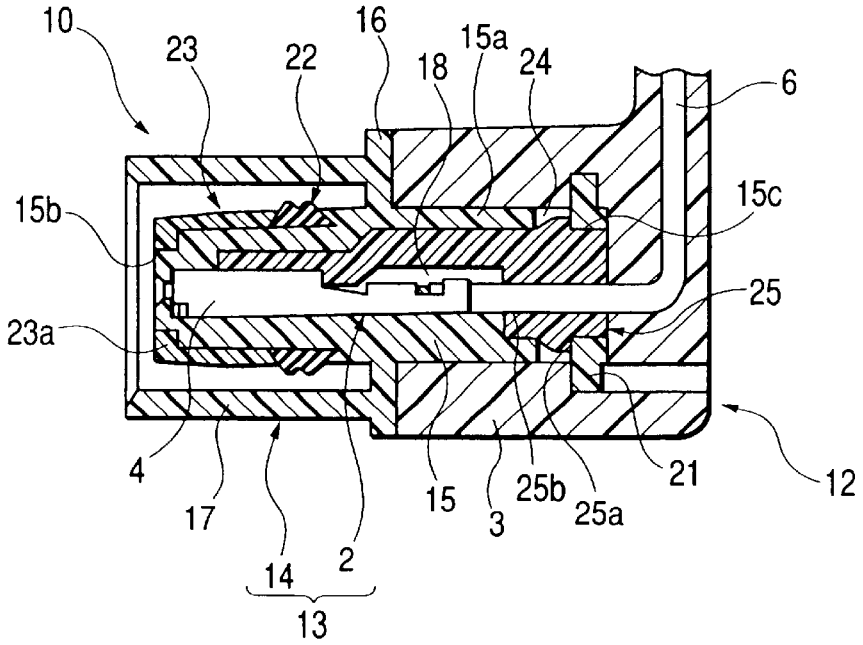
FIG. 4 is a cross-sectional view of the molded connector member of FIG. 3.

In the case where the terminal 4, clamped to an end portion of each wire 6, is of the female type, the molded connector member 10 comprises a waterproof connector 13, and the insulative covering layer 3 in which the waterproof connector 13 is insert-molded, as shown in FIGS. 3 and 4.

The waterproof connector 13 comprises a connector housing 14 of the waterproof type, and the terminal-assembled wire members 2 inserted in the connector housing 14.

The connector housing 14 includes a male housing body 15, a perpendicular wall 16 formed on a central portion of an outer surface 15*a* of the housing body 15 over an entire periphery thereof, a waterproof wall 17 extending from an outer peripheral edge of the perpendicular wall 16, and a flash wall 21 formed on the outer surface 15*a* of the housing body 15 at a rear end thereof. A plurality of terminal receiving chambers 18 are formed in the housing body 15. The perpendicular wall 16 is disposed perpendicularly to the outer peripheral wall 15*a*. The waterproof wall 17 extends toward a fitting side (front surface) 15*b* of the housing body 15.

A retaining step portion 19 is formed on the central portion of the outer surface 15*a* over the entire periphery thereof, and a retaining recess 20 is formed in the outer surface 15*a* at the fitting side 15*b*, and the flash wall 21 is formed on and projects from the outer surface 15*a* at a terminal-inserting side (rear surface 15*c*). An annular waterproof packing 22 is fitted on the outer surface 15*a*, and is engaged with the retaining step portion 19. Two annular lips 22*a* are formed on an outer surface of the waterproof packing 22. A packing holder 23 for holding the waterproof packing 22 is mounted on the outer surface 15*a*. A retaining projection 23*a* is formed on an inner surface of the packing holder 23, and is engaged in the retaining recess 20. Holes 23*b*, corresponding respectively to the terminal receiving chambers 18, are formed in the packing holder 23. The flash wall 21 results from a flash (excess resin material squeezed out and solidified) formed when the connector housing 13 is molded of a resin material. The flash wall 21 holds the connector housing 14 against movement when insert-molding the waterproof connector 13 with a resin material.

Engagement holes 24 are formed in that portion of the outer surface 15*a* of the housing body 15 disposed adjacent to the flash wall 21. Engagement projections 25*a*, formed on an outer surface of a terminal holder 25, are engaged in the engagement holes 24, respectively. Thus, the terminal holder 25 is attached to the housing body 15. A plurality of wire passage holes 25*b*, corresponding respectively to the terminal receiving chambers 18, are formed through the terminal holder 25, and the wires 6 are passed respectively through these wire passage holes 25*b*. When the terminal holder 25 is attached to the housing body 15, those portions of the wires 6, received within the waterproof connector 13, are held or retained.

Referring back to FIG. 1, the wire circuit member 12 comprises the plurality of wires 6, extending outwardly from the waterproof connector 13, and the insulative covering layer 3 in which the wires 6 are insert-molded.

Figure 5:
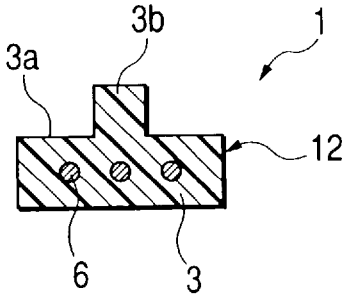
FIG. 5 is a vertical cross-sectional view of a wire circuit member in FIG. 1.

The wires 6 are arranged at predetermined intervals. As shown in FIG. 5, a plurality of projections 3*b* are formed on an upper surface 3*a* of the insulative covering layer 3.

The wire module of FIG. 1 is used in an engine room of a vehicle (not shown). Therefore, the connector housing 14, shown in FIG. 3, need to be molded of a resin material having excellent heat resistance. Examples of such a resin material include polybutylene terephthalate (PBT) and low water absorption nylon (HPA). The insulative covering layer 3 is molded of a resin material different from the resin material of the connector housing 14, and one example thereof is polypropylene (PPT) containing talc.

As shown in FIGS. 3 and 4, the resin material of the connector housing 14 is different from the resin material of the insulative covering layer 3, and a resin material, which is less expensive than the resin material of the connector housing 14, is selected for the insulative covering layer 3. By doing so, the cost of the wire module 1 can be reduced.

Figure 6:
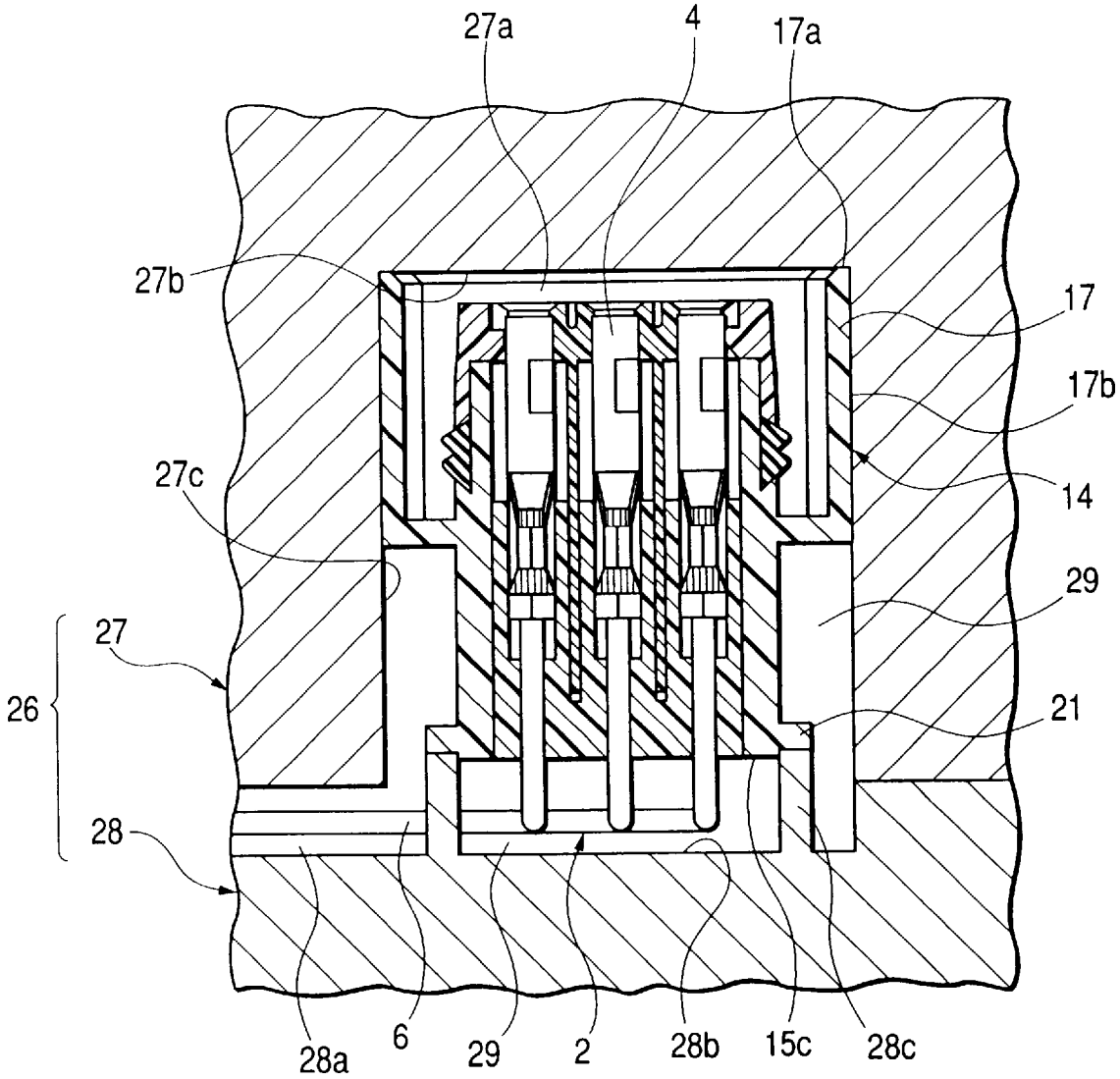
FIG. 6 is a cross-sectional view of a molding-die main body for forming the molded connector member of FIG. 3.

As shown in FIG. 6, a molding-die main body 26, used in the production of the wire module 1 (that is, used for forming the insulative covering layer 3), comprises a vertically-movable (upwardly-downwardly movable) upper molding die 27, and a fixed-lower molding die 28 disposed beneath the upper molding die 27. The upper molding die 27 has a housing cavity 27*a* for receiving the waterproof connector 13. The lower molding die 28 has a wire receiving cavity 28*a* for receiving the wires 6 extending outwardly from the waterproof connector 13. Support pins 28*c* for supporting the connector housing 14 are formed upright on a bottom surface 28*b* of the wire receiving cavity 28*a*.

Next, a method of producing the molded connector member 10 employing the female terminals 4, as well as a method of producing the wire circuit member 12, will be described.

As shown in FIGS. 1 and 2, the female terminals 4 are pressed to be clamped to the wires 6, respectively, thereby providing the plurality of terminal-assembled wire members 2. As shown in FIG. 3, the terminal-assembled wire members 2 are inserted into the connector housing 14, thereby providing the waterproof connector 13. As shown in FIG. 6, the waterproof connector 13 and the wires 6, extending from the waterproof connector 13, are set in the molding-die main body 26. More specifically, the wires 6 are arranged at equal intervals in the wire receiving cavity 28*a* in the lower molding die 28, and the flash wall 21 is supported on the support pins 28*c*. In this condition, the waterproof connector 13 is upstanding relative to the lower molding die 28, and the arranged wires 6 are generally perpendicular to the waterproof connector 13. Namely, the waterproof connector 13 and the wires 6 are arranged to jointly assume an L-shape.

The upper molding die 27 is moved downward, and the upper molding die 27 and the lower molding die 28 are mated together in a die-closed condition, with the connector housing 14 received in the housing cavity 27*a*. In this condition, a free end 17*a* of the waterproof wall 17 is held in intimate contact with an upper surface 27*b* of the housing cavity 27*a*, and an outer peripheral surface 17*b* of the waterproof wall 17 is held in intimate contact with an inner peripheral surface 27*c* of the housing cavity 27*a*. When the molding-die main body 26 is closed, a resin-filling space 29 is formed.

The resin material is poured through a pouring port (not shown), and is filled in the resin-filling space 29. After the poured resin is cooled, the upper molding die 27 is moved upward, thus opening the molding-die main body 26. As a result, the molded connector member 10 and the wire circuit member 12 are formed to provide an integral molded construction in such a manner that the resin material covers the rear surface 15*c* of the waterproof connector 13 and the L-shaped wires 6.

Thus, the time and labor, required for removing the flash wall 21 formed when molding the connector housing 14 by the resin material, are saved (see FIG. 6), and therefore the process of producing the connector housing 14 can be simplified.

The terminal holder 25 is attached to the housing body 15 of the waterproof connector 13 from the rear side 15*c* thereof, and therefore when molding the waterproof connector 13 with the resin material, the resin material (flashed resin) is prevented from intruding into the waterproof connector 13 from the rear side 15*c* thereof.

In the first embodiment, although the waterproof connector 13 is provided at one ends of the wires 6, the waterproof connectors 13 can be provided at the opposite end portions of the wires 6, respectively, so as to provide the wire module 1.

Figure 7:
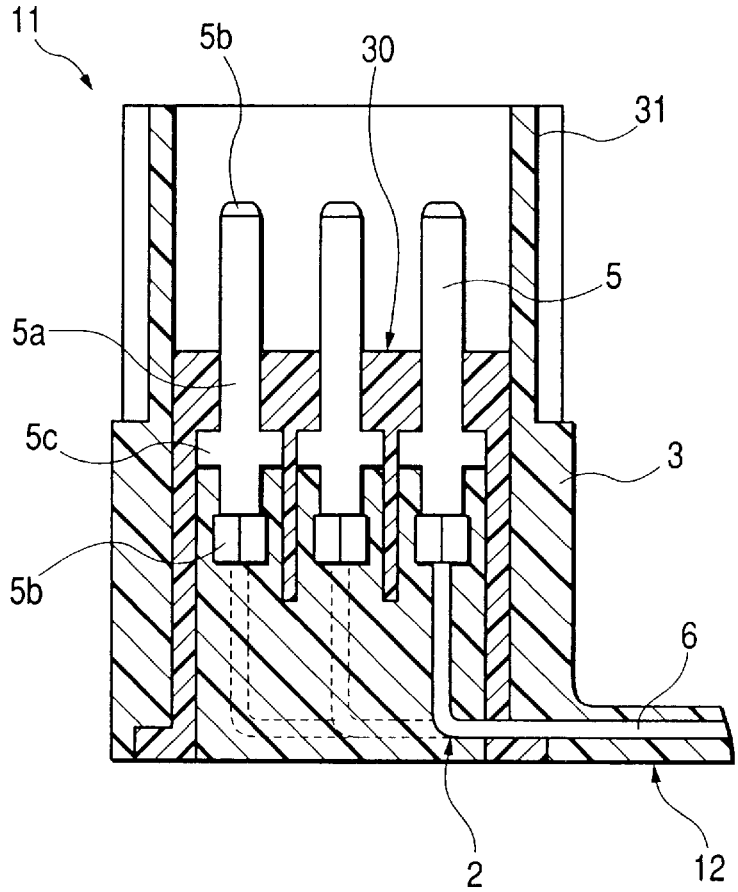
FIG. 7 is a vertical cross-sectional view of a molded connector member 11 in FIG. 1.
Figure 8:
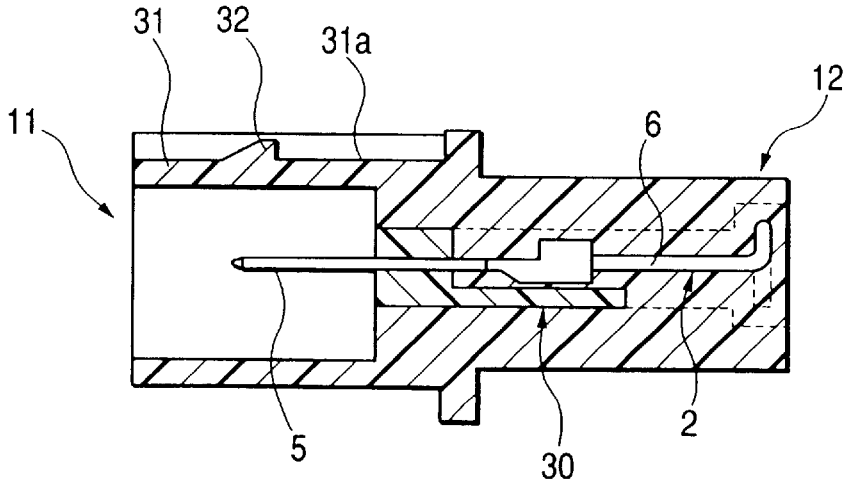
FIG. 8 is a cross-sectional view of the molded connector member of FIG. 7.

In the case where the terminals 5 are of the male type as shown in FIGS. 7 and 8, the molded connector member 11 comprises the terminal-assembled wire members 2, a terminal-erecting holder 30, which holds the terminal-assembled wire members 2, and the insulative covering layer 3 in which the terminal-assembled wire members 2 and the terminal-erecting holder 30 are insert-molded. A hood 31 for receiving a mating member (not shown) is formed integrally on a front side of the molded connector member 11 in a projected manner, and a projection 32 for retaining the mating member is formed on an outer surface 31*a* of the hood 31.

The terminal 5 includes an electrically-conductive base plate 5*a*, a tab-like portion 5*b* formed at one end of the base plate 5*a*, a stabilizer 5*c* formed on the base plate 5*a* intermediate opposite end portions thereof, and a clamping portion 5*d* formed at the other end of the base plate 5*a*. The wire 6 is clamped to the clamping portion 5*d* by pressing.

Figure 9:
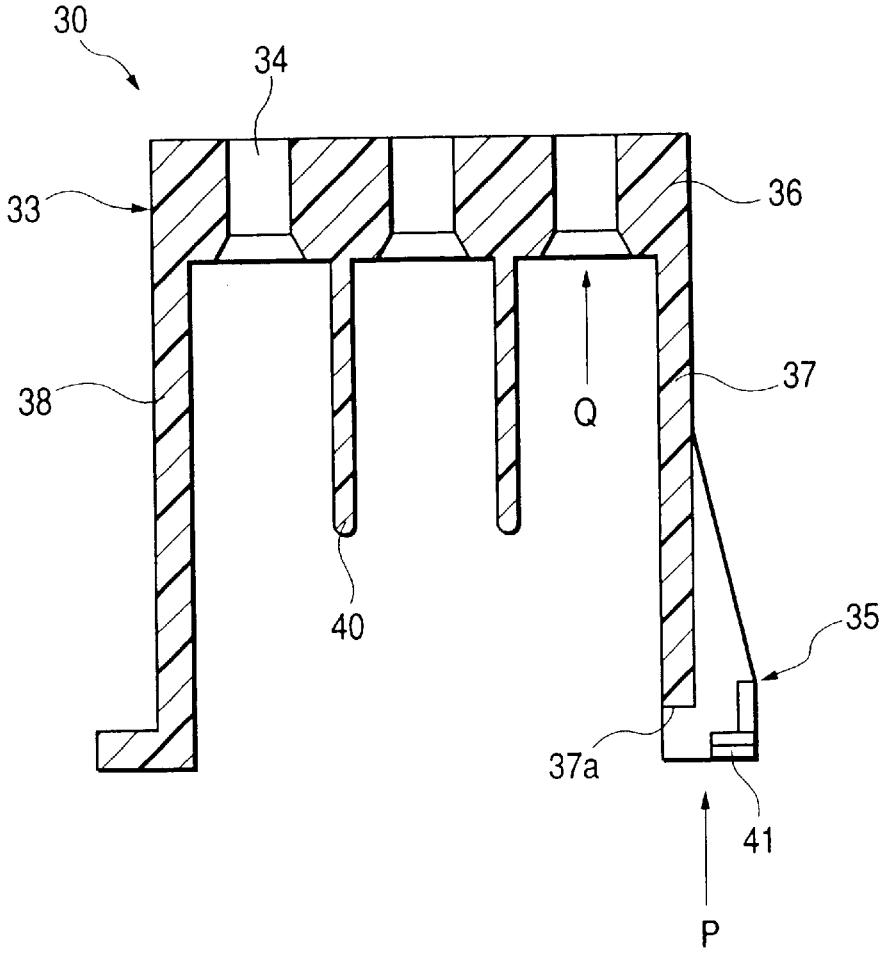
FIG. 9 is a cross-sectional view of a terminal-erecting holder in FIG. 7.
Figure 10:
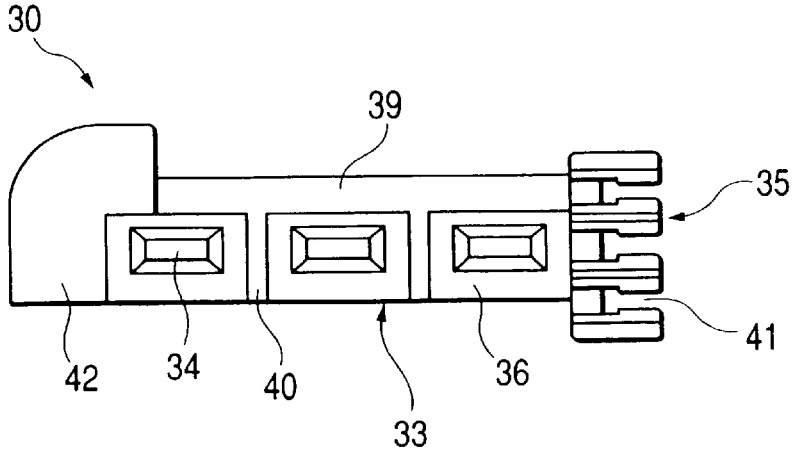
FIG. 10 is a rear view of the terminal-erecting holder of FIG. 7.
Figure 11:
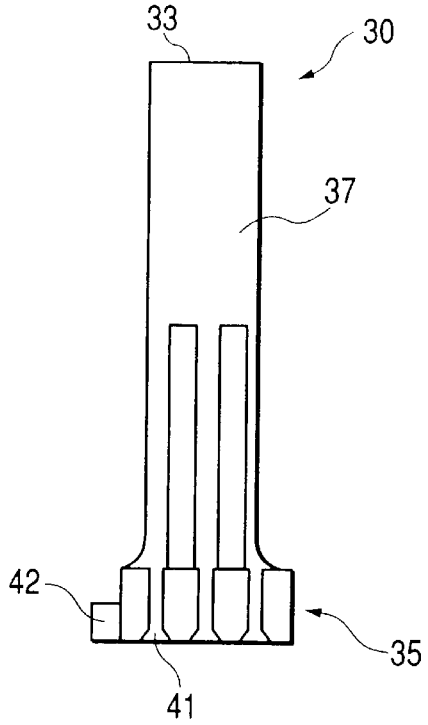
FIG. 11 a side-elevational view of the terminal-erecting holder of FIG. 9.

As shown in FIGS. 9 to 11, the terminal-erecting holder 30 includes a frame body 33 of a U-shaped cross-section, terminal press-fitting holes 34, and a holding portion 35.

As shown in FIG. 9, the frame body 33 includes a top wall 36, a pair of support walls 37 and 38 extending respectively from opposite ends of the top wall 36 in the same direction, and a reinforcing plate 39 (see FIG. 10) covering one sides of the top wall 36 and support walls 37 and 38. The plurality of terminal press-fitting holes 34 are formed through the top wall 36. A plurality of partition walls 40 depend from an inner surface of the top wall 36. The terminal press-fitting holes 34 are separated from one another by the partition walls 40. The tab-like portion 5*b* of the terminal 5 is press-fitted into the terminal press-fitting hole 34, so that the terminal 5 is held in an upstanding (erected) condition. The top wall 36 and the pair of support walls 37 and 38 (shown in FIG. 9) are firmly fixed relative to each other by the reinforcing plate 39 (shown in FIG. 10).

Figure 12:
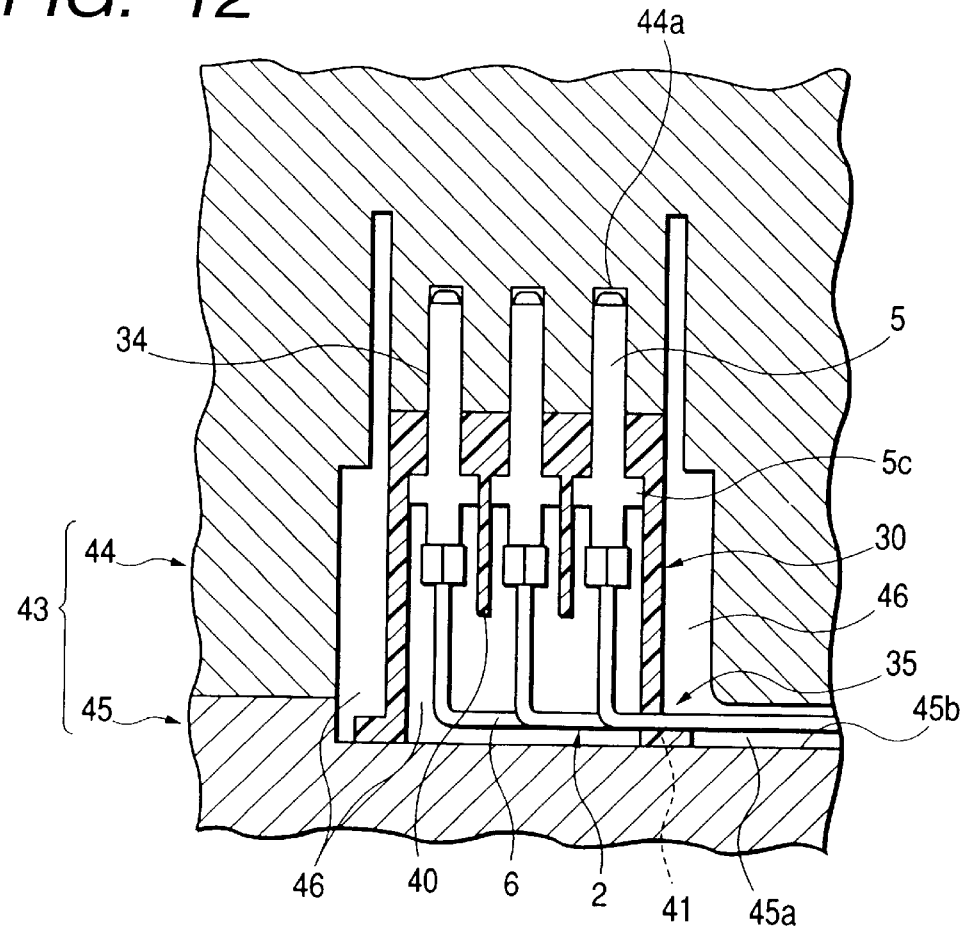
FIG. 12 is a cross-sectional view of a molding-die main body for forming the molded connector member of FIG. 7.

As shown in FIG. 9, the comb-like holding portion 35 is formed integrally on a free end 37*a* of the support wall 37. The holding portion 35 has a plurality of wire holding grooves 41. As shown in FIGS. 9 and 12, a direction P of insertion of the wires 6 into the respective wire holding grooves 41 is the same as a direction Q of press-fitting of the terminals 5 into the respective terminal press-fitting holes 34. Namely, each wire 6 assumes an L-shaped posture within the frame body 33. The wires 6 are fixedly held in the wire holding grooves 41, respectively, and therefore can be fixed against movement within the terminal-erecting holder 30.

As shown in FIGS. 10 and 11, a rearward withdrawal prevention projection 42 is formed at a free end 38*a* of the other support wall 38. The rearward withdrawal prevention projection 42 prevents the terminal-erecting holder 30 from being rearwardly withdrawn from the molded insulative covering layer 3.

A resin material for forming the insulative covering layer 3 (FIG. 1) and the construction of the wire circuit member 12 are almost the same as described above for the first embodiment, and therefore explanation thereof will be omitted.

As shown in FIG. 12, a molding-die main body 43, used in the production of the wire module 1 (that is, used for forming the insulative covering layer 3), comprises a vertically-movable (upwardly-downwardly movable) upper molding die 44, and a fixed-lower molding die 45 disposed beneath the upper molding die 44. The upper molding die 44 has terminal cavities 44*a* for respectively receiving the terminals 5 held by the terminal-erecting holder 30. The lower molding die 45 has a molding cavity 45*a* for receiving the terminal-erecting holder 30 and the wires 6 extending outwardly from the terminal-erecting holder 30. When the upper molding die 44 and the lower molding die 45 are mated together in a die-closed condition, a resin-filling space 46 is formed. The terminal-erecting holder 30 is held against a bottom surface 45*b* of the molding cavity 45*a* in an upstanding condition, and the wires 6 are arranged over the bottom surface 45*b*.

Next, a method of producing the molded connector member 11 employing the male terminals 5, as well as a method of producing the wire circuit member 12, will be described.

As shown in FIG. 1, the male terminals 5 are pressed to be clamped to the wires 6, respectively, thereby providing the plurality of terminal-assembled wire members 2. As shown in FIGS. 7 and 8, the terminals 5 of the terminal-assembled wire members 2 are press-fitted into the terminal press-fitting holes 34 in the terminal-erecting holder 30, and then the wires 6 of the terminal-assembled wire members 2 are forced respectively into the wire holding grooves 41 to be fixed thereto. As a result, the wires 6 are held in a generally L-shaped posture within the terminal-erecting holder 30.

As shown in FIG. 12, the terminal-erecting holder 30 is placed on the bottom surface 45*b* of the molding cavity 45*a* in the lower molding die 45 in an upstanding condition, and the wires 6, extending from the terminal-erecting holder 30, are arranged at predetermined intervals.

The upper molding die 44 is moved downward, and the upper molding die 44 and the lower molding die 45 are mated together in a die-closed condition, and the resin material is poured through a pouring port (not shown), and is filled in the resin-filling space 46. After the poured resin is cooled, the upper molding die 44 is moved upward, thus opening the molding-die main body 43. As a result, the molded connector member 11 and the wire circuit member 12 are formed to provide an integral molded construction in such a manner that the terminal-erecting holder 30 and the wires 6 are molded in this molded construction.

Thus, the terminals 5 are first held in an upstanding (upright) condition by the terminal-erecting holder 30 while the wires 6 are fixedly held in the wire holding grooves 41, as shown in FIG. 12. Therefore, when the upper molding die 44 and the lower molding die 45 are mated together to close the molding-die main body 43, the displacement of the wires 6, as well as the sandwiching engagement of the molding dies with the wires 6, can be prevented. And besides, the wires 6 can be easily formed into an L-shaped posture by the terminal-erecting holder 30.

Although the terminal-erecting holder 30 is provided at one ends of the wires 6, the terminal-erecting holders 30 can be provided at the opposite end portions of the wires 6, respectively.

In the above embodiment, the female terminals 4 can be clamped respectively to one ends of the wires 6 whereas the male terminals 5 can be clamped respectively to the other ends of the wires 6, as shown in FIG. 1.

As described above, in the present invention, the plurality of terminal-assembled wire members are arranged in the insulative covering layer. Therefore, the connector molded member can be formed, utilizing the terminals of the terminal-assembled wire members, and also the wire circuit member can be formed, utilizing the wires of the terminal-assembled wire members. Thus, the wire module, including the molded connector members and the wire circuit member, can be formed.

In the case where the terminals are of the female type, the molded connector member comprises the connector housing, in which the terminal-assembled wire members are inserted, and the terminal holder attached to the terminal-inserting side of the connector housing. Therefore, when the terminal holder is attached to the connector housing, the terminal-inserting side of the connector housing is sealed. Therefore, when this connector housing in this sealed condition is insert-molded in the resin material, the resin material (flash) is prevented from intruding into the connector housing through the terminal-inserting side thereof during the molding operation.

The connector housing is of the waterproof type, and includes the waterproof wall which is formed in a bulged manner on the outer peripheral surface of the housing body, receiving the terminals therein, and extends in a direction away from the terminal-inserting side. Therefore, that side of the connector housing, facing away from the terminal-inserting side, can be surrounded by this waterproof wall. Therefore, when the connector housing is insert-molded in the resin material, the resin material (flash) is prevented from intruding into the connector housing through the waterproof wall side.

In the case where the terminals are of the male type, the molded connector member includes the terminal-erecting holder fixing the terminal-assembled wire members and the wires. Therefore, the molded connector member can be formed, with the terminals and the wires held by the terminal-erecting holder, and therefore the displacement of the terminals and the wires during the molding operation is prevented. As a result, the quality of the molded connector member is enhanced.

The terminal-erecting holder includes the frame body of a U-shaped cross-section, the plurality of terminal press-fitting holes formed through the top wall of the frame body, and the wire holding grooves formed in the free end of one of the two support walls of the frame body. Therefore, the displacement of the terminals and the wires during the insert-molding operation is prevented. Therefore, for example, the sandwiching engagement of the molding dies with the wires is prevented.

The wires (each having the terminal press-fitted in the terminal press-fitting hole), held respectively in the wire holding grooves, are held in an L-shaped condition. Therefore, the efficiency of the molding operation, in which the wire module is molded with the terminals held in an upstanding condition, can be enhanced.

The connector housing is insert-molded in the resin material which is different from the resin material of which the connector housing is molded. Therefore, for example, the connector housing is molded of the heat-resistant resin material whereas the resin material, in which the connector housing is insert-molded, is not heat-resistant, and by doing so, the material cost can be reduced. Therefore, the production cost of the wire module can be reduced.

What is claimed is:

1. A method of producing a wire module, comprising the steps of:

connecting female terminals to opposite end portions of a wire to form a terminal-assembled wire member;

inserting opposite end portions of the terminal-assembled wire member into connector housings molded of a heat-resistant resin material;

insert-molding the connector housings with a resin material which is different from the heat-resistant resin material of which the connector housings are molded; and molding the terminal-assembled wire member with a resin material to form an insulative covering layer which covers the terminal-assembled wire member.

2. The method of claim 1, wherein the molding step includes covering at least parts of the connector housings with the insulative covering layer.

3. The method of claim 1, further comprising a step of attaching terminal holders respectively to terminal-inserting sides of the connector housings.

4. The method of claim 1, wherein the connector housings are of the waterproof type, and each of which includes a waterproof wall which is formed in a bulged manner on an outer peripheral surface of a housing body, receiving the terminals therein, and extends in a direction away from the terminal-inserting side.

* * * * *